US006811246B1

(12) United States Patent
Hayashi et al.

(10) Patent No.: US 6,811,246 B1
(45) Date of Patent: Nov. 2, 2004

(54) INK-JET IMAGE FORMING DEVICE

(75) Inventors: Kunitoshi Hayashi, Tokyo (JP); Iwao Kawamura, Tokyo (JP)

(73) Assignee: Canon Finetech Inc., Ibaraki (JP)

( * ) Notice: Subject to any disclaimer, the term of this patent is extended or adjusted under 35 U.S.C. 154(b) by 0 days.

(21) Appl. No.: 10/018,854

(22) PCT Filed: Jun. 30, 2000

(86) PCT No.: PCT/JP00/04330

§ 371 (c)(1),
(2), (4) Date: Apr. 2, 2002

(87) PCT Pub. No.: WO01/02174

PCT Pub. Date: Jan. 11, 2001

(30) Foreign Application Priority Data

Jun. 30, 1999 (JP) ..... 11/186804

(51) Int. Cl.[7] ..... B41J 2/015; B41J 2/014; B41J 2/016

(52) U.S. Cl. ..... 347/50; 347/20

(58) Field of Search ..... 347/50, 20

(56) References Cited

U.S. PATENT DOCUMENTS 4,907,018 A * 3/1990 Pinkerpell et al. ..... 346/139 R
5,189,787 A * 3/1993 Reed et al. ..... 29/831
5,461,482 A * 10/1995 Wilson et al. ..... 347/50
5,598,194 A * 1/1997 Hall et al. ..... 347/50
5,629,725 A * 5/1997 Buican ..... 347/49
5,684,518 A * 11/1997 Nobel et al. ..... 347/50
5,706,040 A * 1/1998 Reid et al. ..... 347/50
5,796,417 A * 8/1998 Nobel ..... 347/50
5,949,453 A * 9/1999 Harris et al. ..... 347/43
5,953,028 A * 9/1999 Nobel et al. ..... 347/50
6,164,771 A * 12/2000 Eckard et al. ..... 347/86
6,174,046 B1 * 1/2001 Reid et al. ..... 347/50
6,224,192 B1 * 5/2001 Robinson et al. ..... 347/49
6,227,651 B1 * 5/2001 Watts et al. ..... 347/50
6,305,786 B1 * 10/2001 Plotkin et al. ..... 347/50
6,341,844 B1 * 1/2002 Uchikata et al. ..... 347/50

FOREIGN PATENT DOCUMENTS

JP 7-156379 6/1995

* cited by examiner

*Primary Examiner*—Lamson Nguyen
*Assistant Examiner*—Leonard Liang
(74) *Attorney, Agent, or Firm*—Dellett & Walters

(57) ABSTRACT

A contrast base 40 is pushed by the printing head 18K, when the printing head 18K is mounted onto the carriage 16. Thereby, the connection face 32 of the flexible carriage wiring 30 together with the contact base 40 follows the connection face 62 of the of the flexible head wiring by swinging movement around the touching point in the directions of arrows X, X', Y, Y', Z, and Z'. Therefore, the connection face 32 slants to follow any slanting of the connection face 62. Consequently, the two connection faces 32, 62 come close together over the entire faces to give precise electric connection of the electric connection points between the two connection faces.

20 Claims, 10 Drawing Sheets

INK-JET IMAGE FORMING DEVICE

TECHNICAL FIELD

The present invention relates to an ink-jet type image-forming apparatus (hereinafter referred to as an "ink-jet imaging apparatus") which prints images by ejecting ink onto a recording medium.

BACKGROUND TECHNIQUE

Ink-jet imaging apparatuses for printing by ejecting ink onto a recording medium are known as a kind of output apparatus of computers and work stations. The ink-jet imaging apparatuses are generally provided with a printing head which has plural ink ejection outlets, a carriage which carries the printing head and is moved in reciprocation in a prescribed main scanning direction, and a delivery device which delivers a recording paper sheet in the direction perpendicular to the main scanning direction (the recording medium delivery direction, hereinafter referred to as a "sub-scanning direction").

In formation of an image on a recording paper sheet, the delivery of the recording sheet is temporarily stopped, and an ink is ejected through an ink ejection outlet with the reciprocating movement of the carriage in the main scanning direction in accordance with image signals to form one printing band portion of an image on the area of the recording sheet placed on an image formation zone confronting the ink ejection outlet. Then the recording paper sheet is delivered by a distance of one printing band breadth and stopped, and again an ink is ejected through an ink ejection outlet with the reciprocating movement of the carriage in the main scanning direction in accordance with image signals to form another printing band portion of an image on the newly delivered area of the recording sheet on the image formation zone. By repeating the operation, an entire image is formed on the recording paper sheet.

The printing head and the carriage have respectively a circuit face (circuit pattern) to transmit the image signals. The each of the circuit faces has plural electric connection points for electric connection. The pairing of the connection points of the one circuit face with those of the other circuit face is predetermined. Interconnection of the predetermined pairs of the electric connection points enables precise transmission of image signals from the carriage to the printing head. Thus, in the ink-jet imaging apparatus, on mounting the printing head onto the carriage, the electric connection points of the circuit face formed on the printing head is precisely connected with the electric connection points of the circuit face formed on the carriage.

In order to achieve precise electric connection between the electric connection points of the printing head and those of the carriage, the printing head and the carriage are made with high-precision. Thereby, by mounting the printing head onto the carriage, the electric connection points of the both parts will be electrically connected precisely. In recent years, with downsizing of the imaging apparatus, the carriage and the printing head are coming to be miniaturized. For the miniaturization, the densities of the electric connection point distribution on the circuit faces are made higher. Also, for improvement of the image resolution, the aforementioned densities of the electric connection points on the circuit faces are being increased.

With such a higher density of the electric connection points, the contact points of the printing head and the carriage could be unprecisely interconnected even if the printing head and the carriage are produced with high precision. The unprecise interconnection may cause error in image signal transmission to result in incorrect ejection of the ink from the printing head, which lowers the image quality.

DISCLOSURE OF THE INVENTION

Under the aforementioned circumstances, the present invention intends to provide an ink-jet imaging apparatus in which the electric connection points of a printing head and those of a carriage are precisely interconnected even at a high density of the connection points.

For achieving the above object, the ink-jet imaging apparatus of the present invention is provided with a printing head having a first circuit face having plural first electric connection points, and a carriage having a second circuit face having plural second electric connection points to be connected respectively to the first electric connection points, and forms an image by ejecting an ink from the printing head with reciprocating movement of the carriage in a main scanning direction in accordance with image signals transmitted through the first electric connection points and the second electric connection points, wherein (1) one of the first circuit face and the second circuit face moves to follow the other circuit face;
(2) the first circuit face may follow the second circuit face by movement in a direction crossing the second circuit face;
(3) the second circuit face may follow the first circuit face by movement in a direction crossing the first circuit face;
(4) the first circuit face may follow the second circuit face by movement in a direction nearly parallel to the second circuit face;
(5) the second circuit face may follow the first circuit face by movement in a direction nearly parallel to the first circuit face.

The ink-jet imaging apparatus may be provided also with (6) a contact base which has the second circuit face fixed thereon and follows the first circuit face by movement in the crossing direction, and
(7) a pushing member which is held at least between the second circuit face and the contact base, or between the first circuit face and the printing head;
(8) the contact base may follow the first circuit face by movement in a direction nearly parallel to the first circuit face;
(9) the contact base may be replaced by another contact base which has the first circuit face fixed thereon and follows the second circuit face by movement in the crossing direction;
(10) the contact base may follow the second circuit face by movement in the direction nearly parallel to the second circuit face;
(11) the contact base may have a protrusion formed near the gravity center of the contact base and touching the carriage;
(12) the contact base may follow the first circuit face or the second circuit face by swing movement around the touching point of the protrusion touching the carriage as the center;
(13) the carriage may have a protrusion to touch the contact base at or near the gravity center of the contact base;
(14) the contact base may follow the first circuit face or the second circuit face by swing movement around the touching point of the protrusion touching the contact base as the center; and
(15) the first circuit face or the second circuit face confronting the pushing member may be flexible.

BEST MODE FOR CARRYING OUT THE INVENTION

The present invention will be explained below by reference to drawings.

A first embodiment of the ink-jet imaging apparatus of the present invention is described below by reference to FIG. 1.

Figure 1:
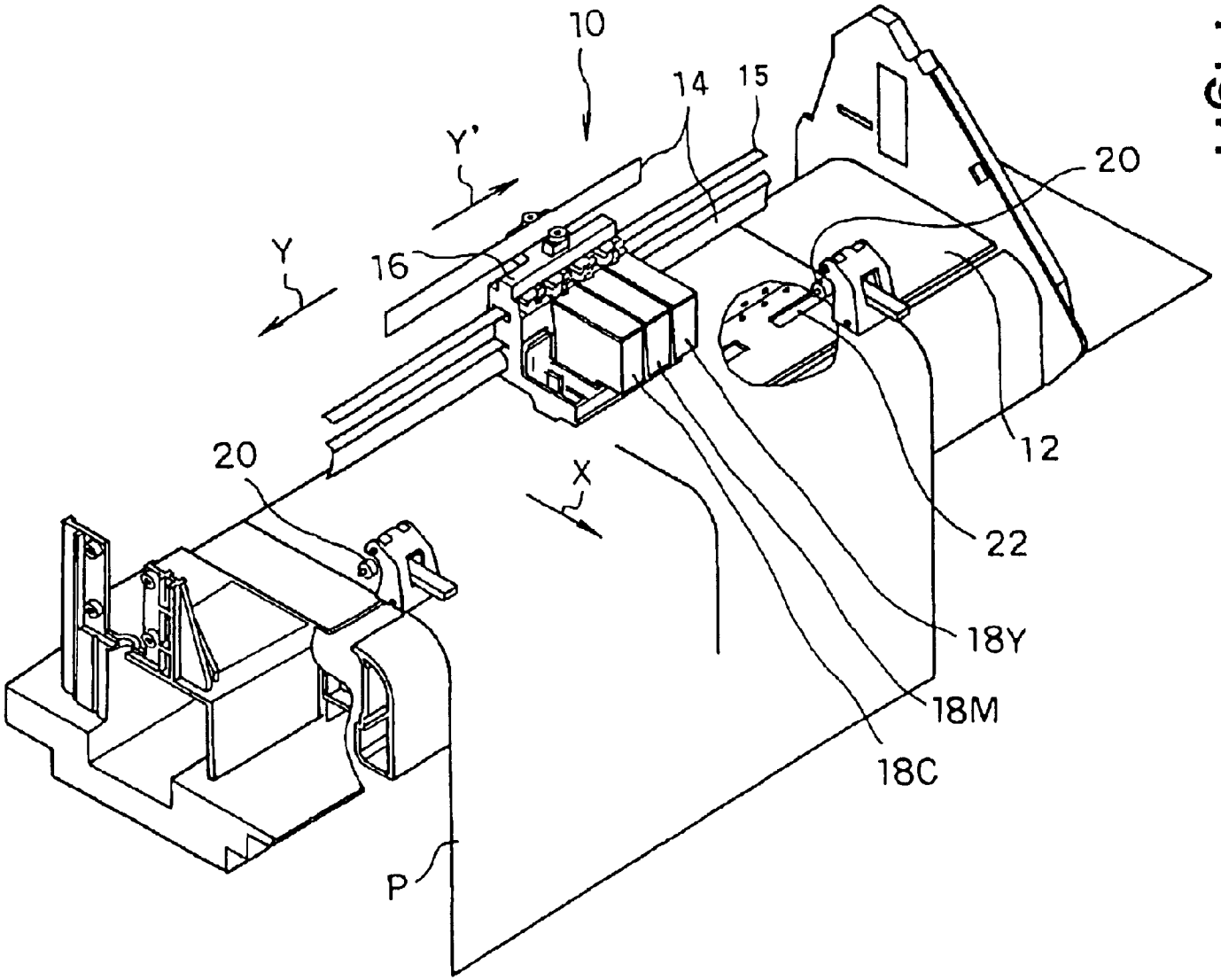
FIG. 1 is a schematic perspective view of a first embodiment of the ink-jet imaging apparatus of the present invention.

FIG. 1 is a schematic perspective view of a first embodiment of the ink-jet imaging apparatus of the present invention.

A plotter 10 has a platen 12 onto which a recording paper sheet P is delivered in the direction shown by the arrow X (sub-scanning direction). Above the platen 12, two guide rails 14 are provided in parallel to the platen 12. Onto the guide rail, a carriage 16 is mounted through a slide bearing (not shown in the drawing). This carriage 16 can be driven in reciprocation (capable of scanning) by a motor (not shown in the drawing) and a belt 15 in the directions of arrows Y,Y' (perpendicular to the arrow X direction, an example of the main scanning direction in the present invention). The carriage 16 has four printing heads of 18K (black, not shown in the drawing), 18C (cyan), 18M (magenta), and 18Y (yellow) mounted thereon detachably.

Each of the printing heads 18K, 18C, 18M, and 18Y has plural ink ejection outlets (not shown in the drawing). The ink ejection outlets confront an image-forming zone. An ink is ejected through the ink ejection outlets onto an area of the recording paper sheet P placed on this image-formation zone in accordance with image signals to form one printing band portion of an image. Thereafter, the recording paper sheet P held between a pinch roller 20 and a delivery roller 22 is delivered by the breadth of one printing band portion, and is stopped. Again, an ink is ejected through the ink ejection outlets in accordance with image signals with reciprocating movement of the carriage 16 in the arrow Y,Y' directions to form a band portion of the image on the area of the recording paper sheet P newly placed on the image formation zone. By repeating such an operation, the entire image is formed on the recording paper sheet P.

The aforementioned image signals are transmitted from the circuit face of the carriage 16 to the circuit face of each of the printing heads 18K, 18C, 18M, and 18Y. The carriage 16 has four circuit faces corresponding respectively to the four printing heads 18K, 18C, 18M, and 18Y. Each of the circuit faces has plural electric connection points. For example, the plural electric connection points on the circuit face of the printing head 18K correspond respectively to one of the electric connection points on the carriage 16. The electric connection points on the circuit face of the printing head 18K are connected respectively to a predetermined electrical connection points of the circuit face of the cartridge 16. Other printing heads 18C, 18M, and 18Y are electrically connected in the same manner.

In the present invention, even if each of the circuit faces has a large number of electric connection points per unit area (the density of the electric connection points is high), the electric connection points on the circuit faces of the printing head 18K, 18C, 18M, and 18Y can precisely be connected respectively to the electric connection points on the carriage 16 on mounting the printing heads 18K, 18C, 18M, and 18Y on the carriage 16. This is explained below.

The structure of the carriage 16 is explained by reference to FIGS. 2–5.

Figure 2:
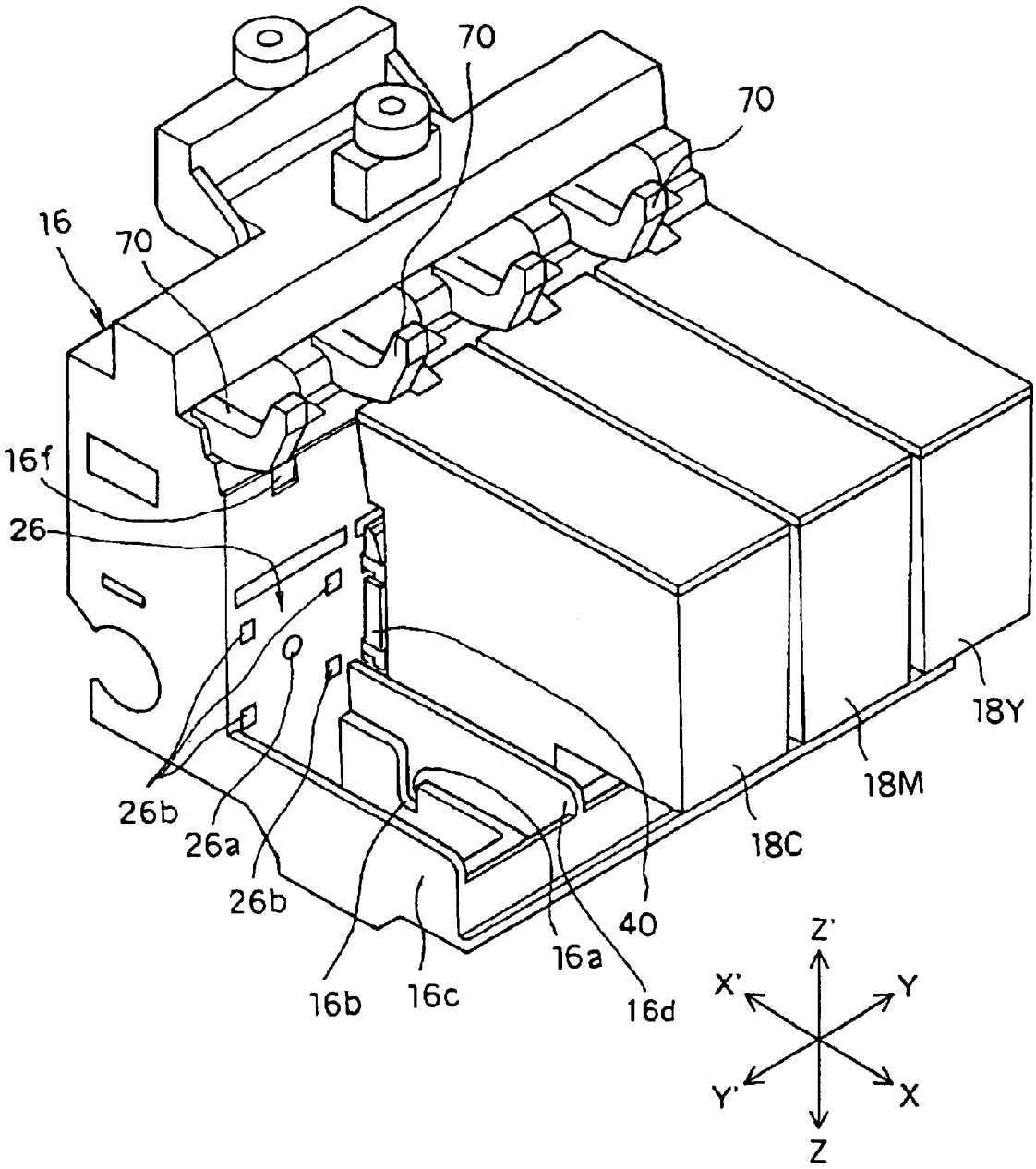
FIG. 2 is a perspective view of a carriage with one printing head and its contact base demounted therefrom.
Figure 3:
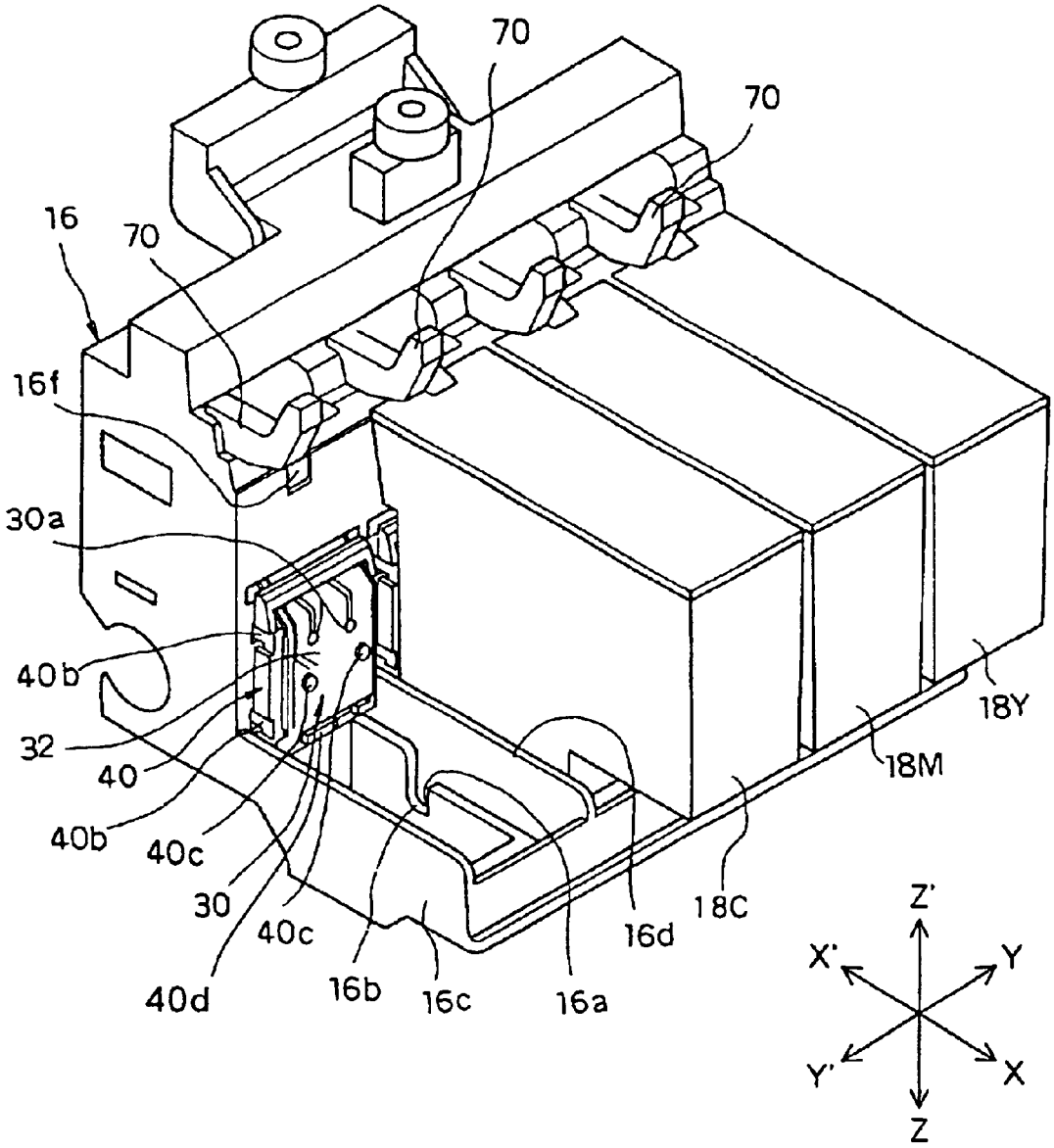
FIG. 3 is a perspective view illustrating a carriage with one printing head demounted but with the contact base thereof mounted.
Figure 4:
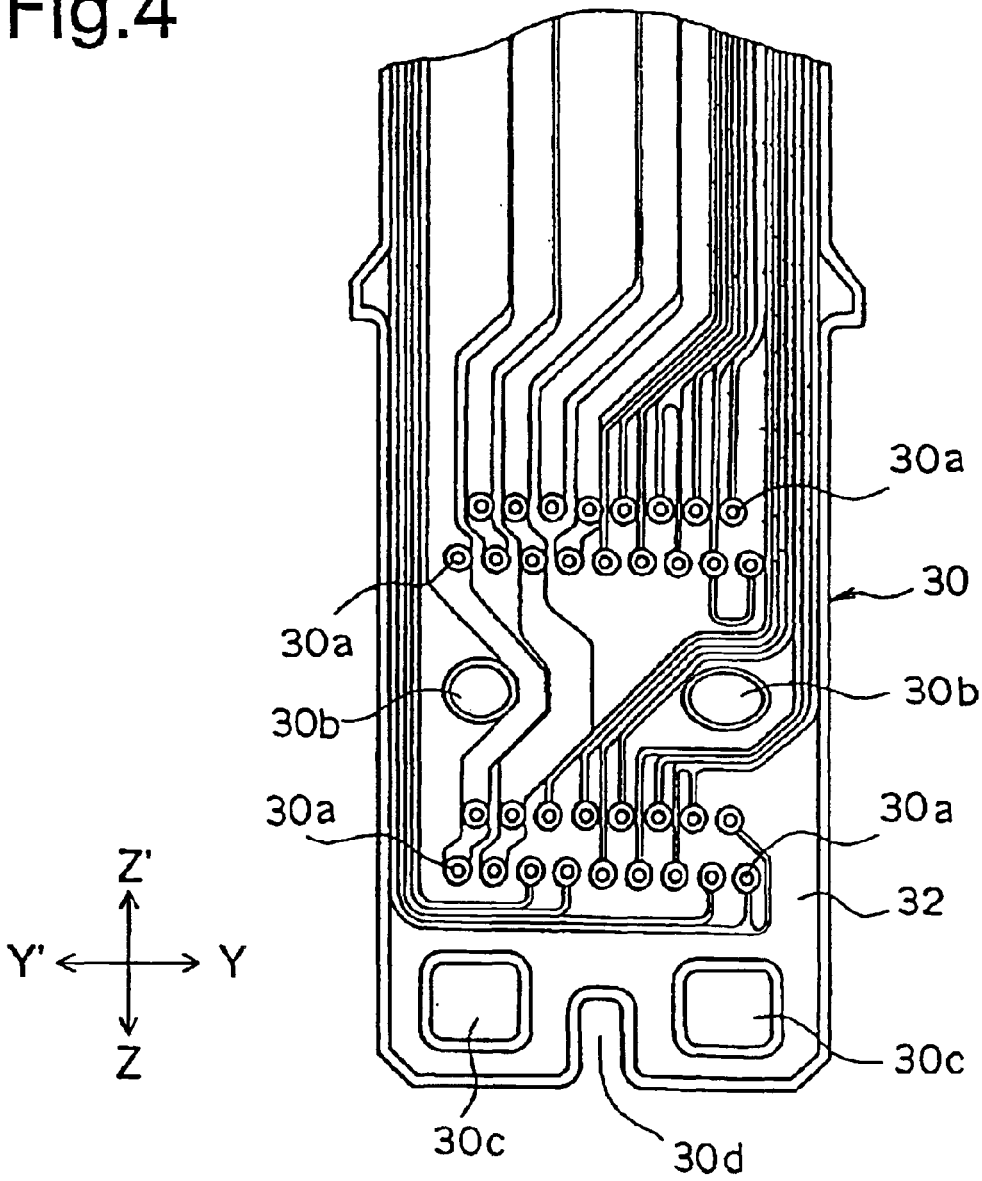
FIG. 4 is a front view of a part of a circuit face formed on a carriage.
Figure 5:
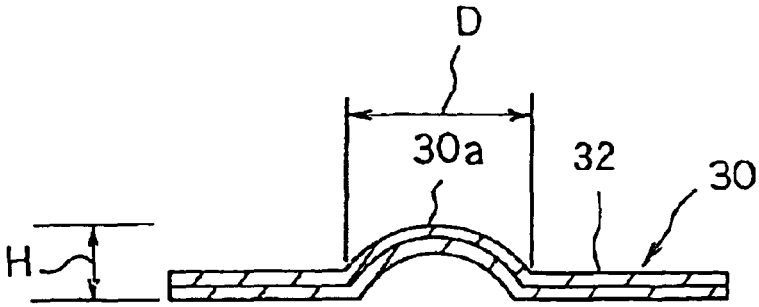
FIG. 5 is a sectional view of an electric contact point portion of a flexible wiring.

FIG. 2 is a perspective view of a carriage 16 with one printing head 18K (black, not shown in the drawing) and its contact base demounted therefrom. FIG. 3 is a perspective view illustrating a carriage with one printing head 18K demounted but with the contact base for the printing head 18K mounted. FIG. 4 is a front view showing a part of a circuit face fixed to the carriage (carriage flexible wiring). FIG. 5 is a sectional view of one electric connection point of a flexible carriage wiring. In FIGS. 2–5, the corresponding constitutional elements are denoted by the same reference numeral as in FIG. 1.

The carriage 16 has a long flexible carriage wiring 30 which has plural electric connection points 30*a*. To the carriage 16, a plate-shaped contact base 40 is attached which fixes the tip portion (a portion shown in FIG. 4) of the flexible carriage wiring 30. One contact base 40 is attached to each of the printing heads 18K, 18C, 18M, and 18Y. Here, the printing head 18K is explained as an example, but the other printing heads 18C, 18M, and 18Y are the same.

The carriage 16 has a receiving face 26 for receiving the printing head 18K as shown in FIG. 2. The contact base 40 is fixed onto the receiving face 26 as shown in FIG. 3. The contact base 40 has a protrusion 40*a* (see FIG. 7) at the center of the face confronting the receiving face 26 (reverse face).

The receiving face 26 has, at its center, a hollow 26*a* for insertion of the protrusion 40*a* (see FIG. 7) of the contact base 40. The protrusion 40*a* of the contact base 40 is inserted into the hollow 26*a* to touch the bottom face of the hollow 26*a* at one point. In this state, the contact base 40 is in contact with the receiving face 26 through the protrusion 40*a* only. Therefore, the contact base 40 is swingable around the touching point as the swing center in the directions of arrows X, X', Y, Y, Z, and Z' (in all directions). The contact base 40 can become slanted or paralleled relative to the receiving face 26. The arrow X,X' directions are perpendicular to the connection face 62 of the flexible head wiring 60, the direction being examples of the crossing direction. The directions of the arrows Y, Y, Z, and Z' are parallel to the connection face 62 of the flexible head wiring 60, the directions being examples of the directions nearly parallel to the second circuit face of the present invention.

The receiving face 26 has four square holes 26*b* around the hollow 26*a* as shown in FIG. 2. The four square holes

Figure 7:
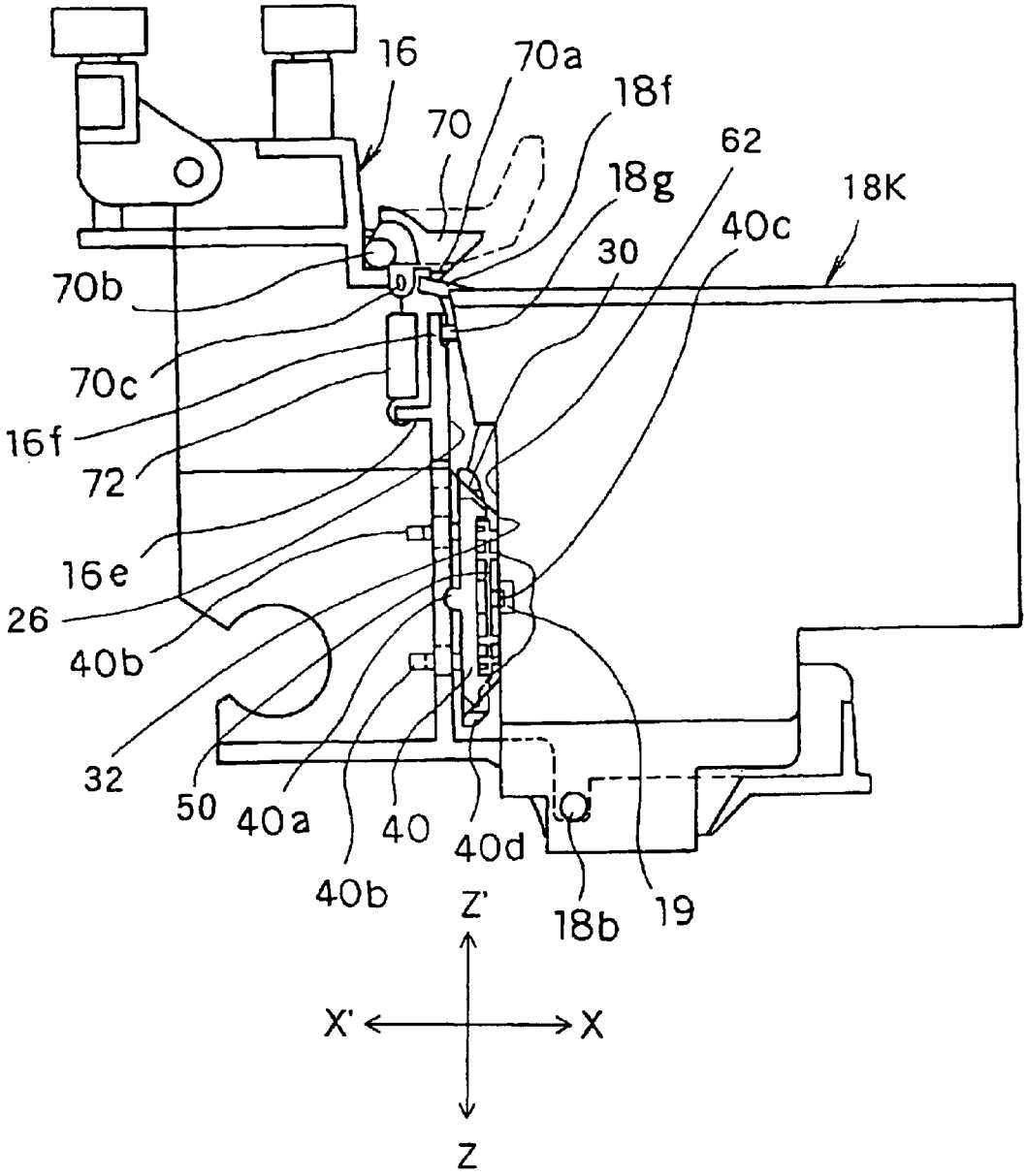
FIG. 7 is a schematic side view of a carriage carrying a printing head.

26*b* hook the nails 40*b* formed on the back face of the contact base 40 as shown in FIG. 7 as mentioned later. This hooking is loose. This hooking limits the swing movement of the contact base 40 around the protrusion 40*a* as the axis within a certain range. Accordingly, the position of fixation of the contact base 40 on the receiving face 26 is roughly limited preliminarily. Although the swing movement of the contact base is limited, the contact base is still swingable around the contact point in the directions of arrows X, X', Y, Y', Z, Z' (in any direction).

The connection face 32 of the aforementioned flexible carriage wiring 30 (an example of the second circuit face in the present invention) has plural spherical protrusions (electrical connection points 30*a*, an example of the second electrical connection point) of 0.5 mm in diameter D, and 0.2 mm in height H formed on the connection face 32 by a forming process as shown in FIG. 5. The base material of the flexible carriage wiring 30 is a polyimide of a thickness of about 0.1 mm.

On the face of the contact base 40 (the face confronting the printing head 18K), two columnar protrusions (embossment) 40*c* are provided at the both end portions of the face in the arrow Y, Y' directions as shown in FIG. 3. The two columnar protrusions 40*c* are fit into the holes 30*b* of the flexible carriage wiring 30. This fitting decides the fixation position of the flexible carriage wiring 30 in the contact base. The protrusions 40*c* are fitted also into holes 50*a* formed on a pushing member 50 (see FIG. 8) mentioned later, which decides the position of fixation of the pushing member 50 on the contact base 40.

At the lower end of the contact base 40, a protrusion 40*d* is provided which extends in the arrow Y, Y' directions. Two holes 30*c* and a notch 30*d* formed at the tip end portion of the flexible carriage wiring 30 are fitted to the protrusion 40*d*. Thereby, the tip end portion of the flexible carriage wiring 30 is fixed at the lower end portion of the contact base 40. The aforementioned holes 30*b*, the two holes 30*c*, and the notch 30*d* decides the position of fixation of the flexible carriage wiring 30 on the contact base 40.

The printing head 18K and the flexible head wiring 60 (see FIG. 6) have respectively a clearance hole 19 (see FIG. 7) and clearance holes 60*a* in order to prevent interference and collision of the protrusion 40*c* of the contact base 40 with the printing head 18K on mounting the printing head 18K onto the carriage 16. Since the collision of the protrusion 40*c* of the contact base 40 against the printing head 18K can be avoided, the printing head 18K and the flexible head wiring 60 are not pushed by the protrusion 40*c*, and are kept close to the contact base 40. Therefore, the connection face 62 of the flexible head wiring 60 is connected to the connection face 32 of the flexible carriage wiring 30 stably at a uniform pressure.

The external structure of the printing head, and the printing head mounted on the carriage are explained by reference to FIG. 6 and FIG. 7.

Figure 6:
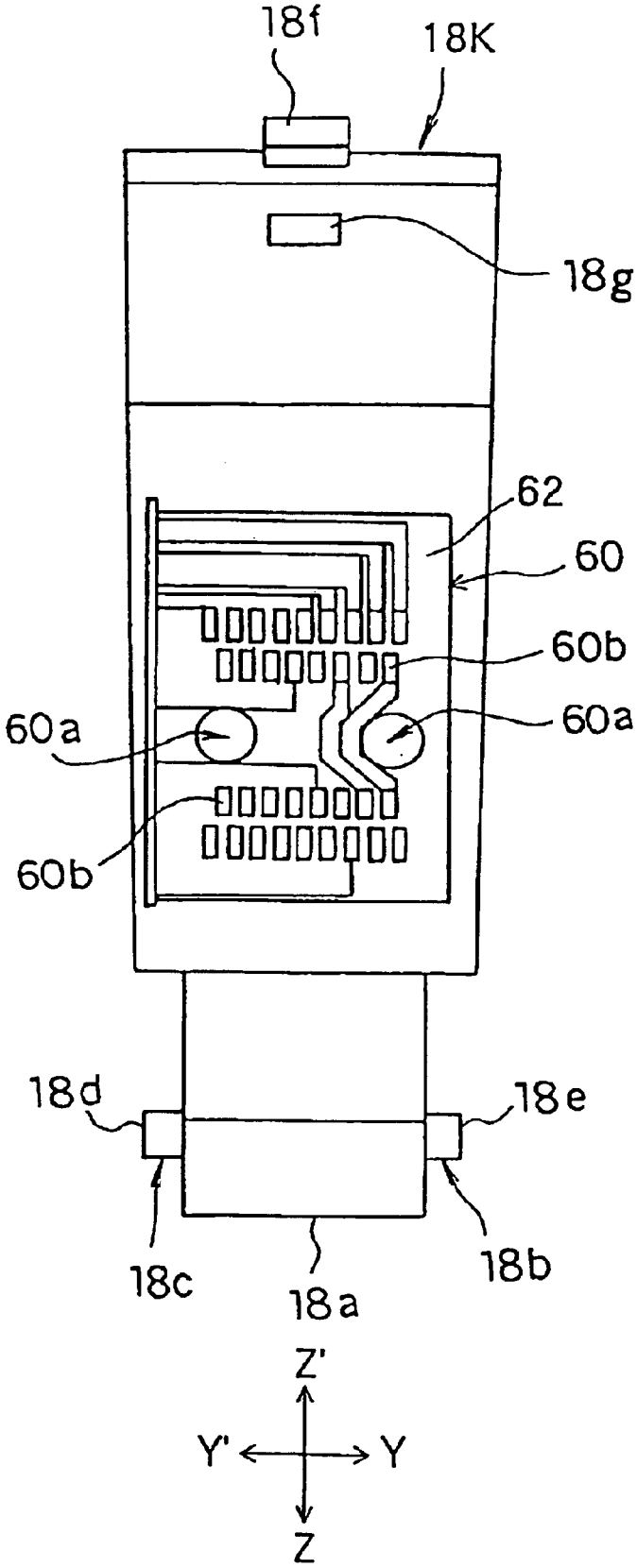
FIG. 6 is a rear view illustrating a back face of a printing head.

FIG. 6 is a rear view illustrating a back face of a printing head. FIG. 7 is a schematic side view of a carriage carrying a printing head. Here the printing head 18K is explained as an example. The other printing heads 18C, 18M, and 18Y have the same structure.

The flexible head wiring 60 is fusion-bonded to the back face of the printing head 18K (the face confronting the flexible carriage wiring 30). On the connection face 62 of the flexible head wiring 60 (an example of the first circuit face of the present invention), plural electric connection points 60*b* (an example of the plural first electric connection points of the present invention) are formed to be connected respectively to the plural electric connection points 30*a* of the flexible carriage wiring 30. The base material of the flexible head wiring 60 is a polyimide of about 0.1 mm thick.

On the side wall of the printing head 18K, two columnar protrusion (embossment) 18*b*, 18*c* are formed near the ink ejection face 18*a* (the face having the ink ejection outlets). The protrusion 18*c* is stopped by a stopping faces 16*a*, 16*b* (see FIGS. 2 and 3) formed on the carriage 16. Therefore, on mounting the printing head 18K onto the carriage 16, the position of the protrusion 18*c* is decided in the directions of arrows X and Z in FIG. 3. The protrusion 18*b* is also stopped in the same manner by the stopping faces (not shown in the drawing) formed on the partitioning wall 16*c* (FIG. 2, and FIG. 3) of the carriage 16. Therefore, on mounting the printing head 18K onto the carriage 16, the setting position of the protrusion 18*b* is decided in the directions of arrows X and Z in FIG. 3.

The shape of the stopping faces formed on the partitioning wall 16*c* are the same as those of the stopping faces 16*a*, 16*b*. The end face 18*e* of the protrusion 18*b* is energized by a spring (not shown in the drawing) fixed to the inside of the partitioning wall 16*c* to push the face 18*d* of the protrusion 18*c* against the stopping face 16*d*, which decides the positions of the protrusions 18*b*, 18*c* in the arrow Y,Y' directions.

The printing head 18K has a slant 18*f* at the top thereof for fixation of the printing head 18K to the carriage 16, and has a projection ,18*g* a little below the slant 18*f*.

The slant 18*f* is pushed by a pressing part 70*a* of a hook 70 attached to the carriage 16 in the arrow X', Z directions as shown in FIG. 7. The hook 70 is attached to the carriage 16 to be turnable around an axis 70*b*. The lower end 70*c* of the hook 70 is caught by the upper end of a tension coil spring 72, and the lower end of the tension coil spring 72 is caught by a spring-catching peg 16*e* of the carriage 16. Thereby, the hook 70 is energized to turn clockwise in FIG. 7 around an axis 70*b*.

The carriage 16 has a control face 16*f* to control the turn of the printing head 18K. On mounting the printing head 18K onto the carriage 16, the projection 18*g* is pushed against the control face 16*f*. Thereby, the printing head 18K is prevented from turning around the protrusions 18*b*, 18*c* in the anticlockwise direction in FIG. 7. That is, the projection 18*g* and the control face 18*f* cooperate to stop the turning of the printing head 18K.

The protrusion 40*a* of the contact base 40 is explained by reference to FIG. 7.

The protrusion 40*a* is formed at the gravity center position of the contact base 40 with its tip rounded. The protrusion 40*a* is put into the hollow 26*a* formed at the center of the receiving face 26 as described above. The hollow 26*a* is a little larger in size than that of the protrusion 40*a*, so that the tip of the protrusion 40*a* comes into point contact with the bottom face of the hollow 26*a*.

As described above, the protrusion 40*a* of the contact base 40 is inserted into the hollow 26*a* and is brought into point contact with the bottom of the hollow 26*a*, and simultaneously the connection face 32 of the flexible carriage wiring 30 is fixed to the contact base 40. On mounting the printing head 18K onto the carriage 16, the contact base 40 is pushed by the printing head 18K, which allows the connection face 32 of the flexible carriage wiring 30 to swing together with the contact base 40 in the arrow X, X', Y, Y', Z, Z' directions around the contact point and allows the connection face 32 to follow the connection face 62 of the flexible head wiring 60 (see FIG. 6). Therefore, if the connection face 62 is slant, the connection face 32 comes to be slanted correspondingly. Consequently, the two connection faces 32, 62 come close at a uniform distance over the entire face to ensure the electric connection between the plural electric connection points 30*a*, 60*b*. Thereby, the electric connection points 60*b*, 30*a* of the printing head 18K and the carriage 16 are precisely connected electrically even if the density of the connection points is high.

Between the flexible carriage wiring 30 and the contact base 40, a pushing member 50 made of rubber is held as shown in FIG. 7. The pushing member 50 pushes the connection face 32 of the flexible carriage wiring 30 against the connection face 62 of the flexible head wiring 60 to ensure further the connection between the plural electric connection points 30*a* of the flexible carriage wiring 30 and the electric connection points 60*b* of the flexible head wiring 60.

The pushing member 50 is explained by reference to FIG. 8.

Figure 8:
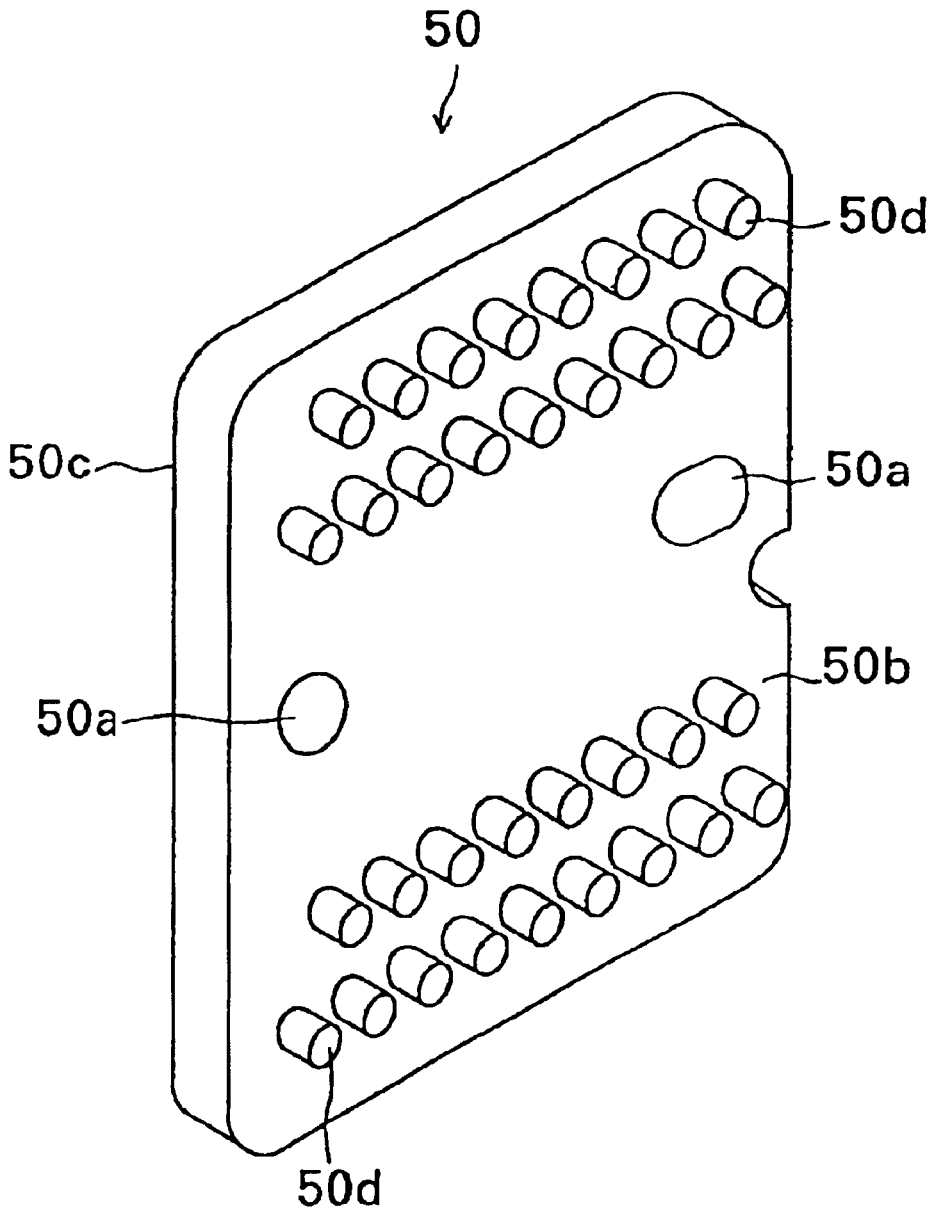
FIG. 8 is a perspective view of a pushing member.

FIG. 8 is a perspective view of a pushing member.

The pushing member 50 has plural columnar protrusions 50*d* of about 1 mm diameter (outside diameter) on its both faces 50*b*, 50*c* (a face confronting the flexible carriage wiring 30 and contact base 40). FIG. 8 shows only the protrusions 50*d* on the side of the face 50*b*. The plural protrusions 50*d* are placed respectively at the points corresponding to the plural electric connection points 30*a* of the flexible carriage wiring 30. The protrusion 50*d* of the pushing member 50 made of rubber respectively push the confronting electric connection points 30*a* against the corresponding electric connection points 60*b* (see FIG. 6) to ensure further the electric connection between the electric connection point 30*a* and the electric connection points 60*b*.

Figure 10:
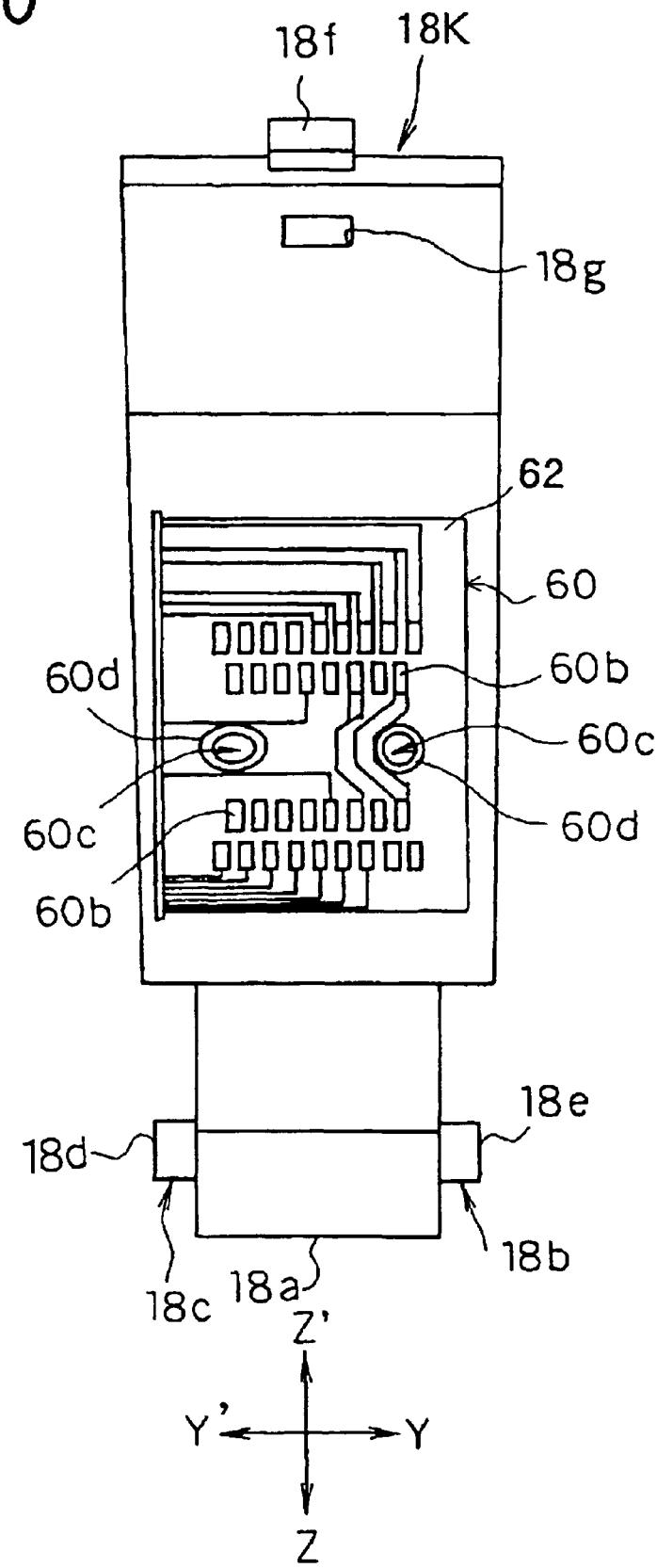
FIG. 10 is a rear view illustrating a back face of a printing head.
Figure 11:
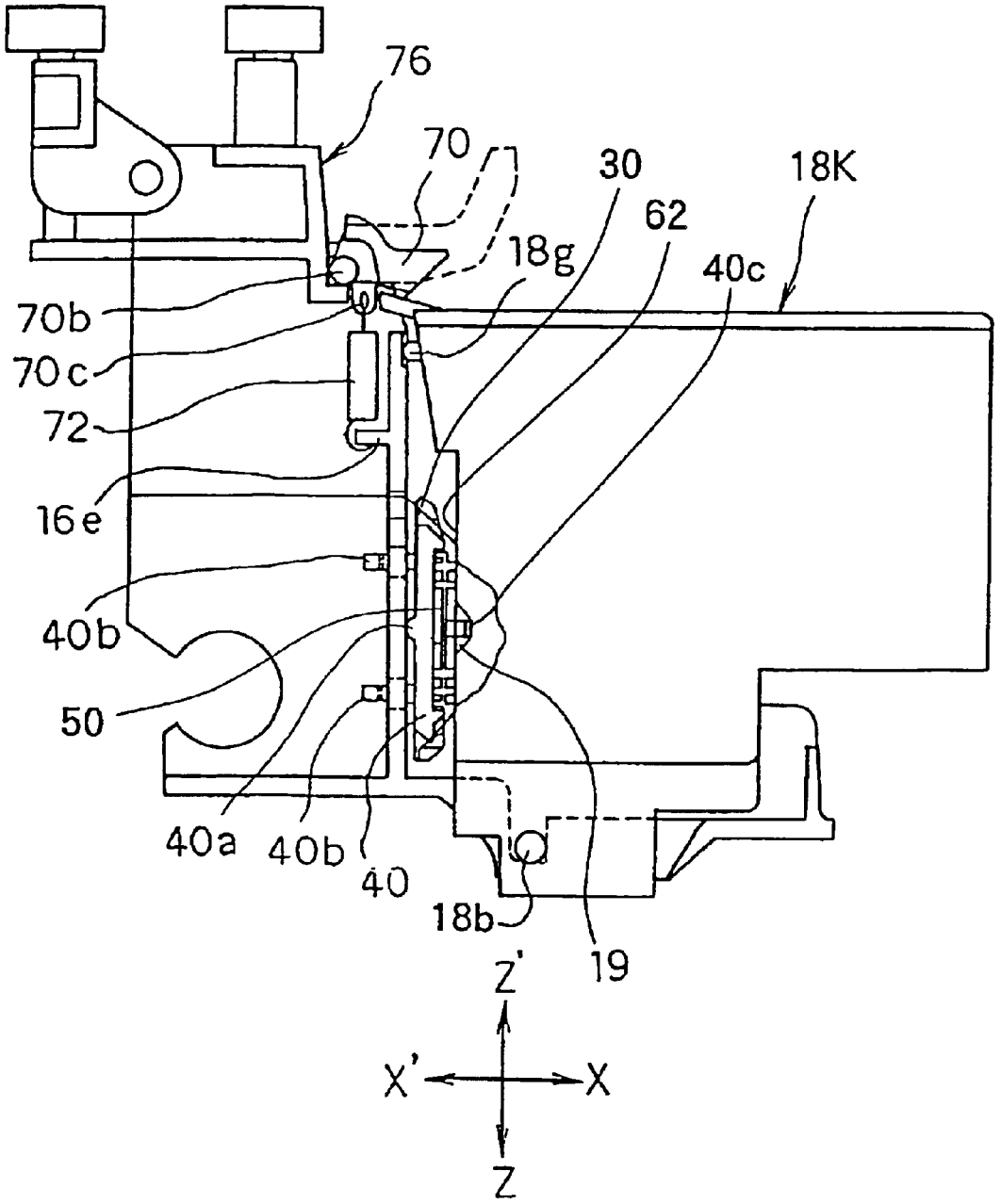
FIG. 11 is a schematic side view of a carriage carrying a printing head.

A second embodiment of the present invention is described by reference to FIGS. 9–11.

Figure 9:
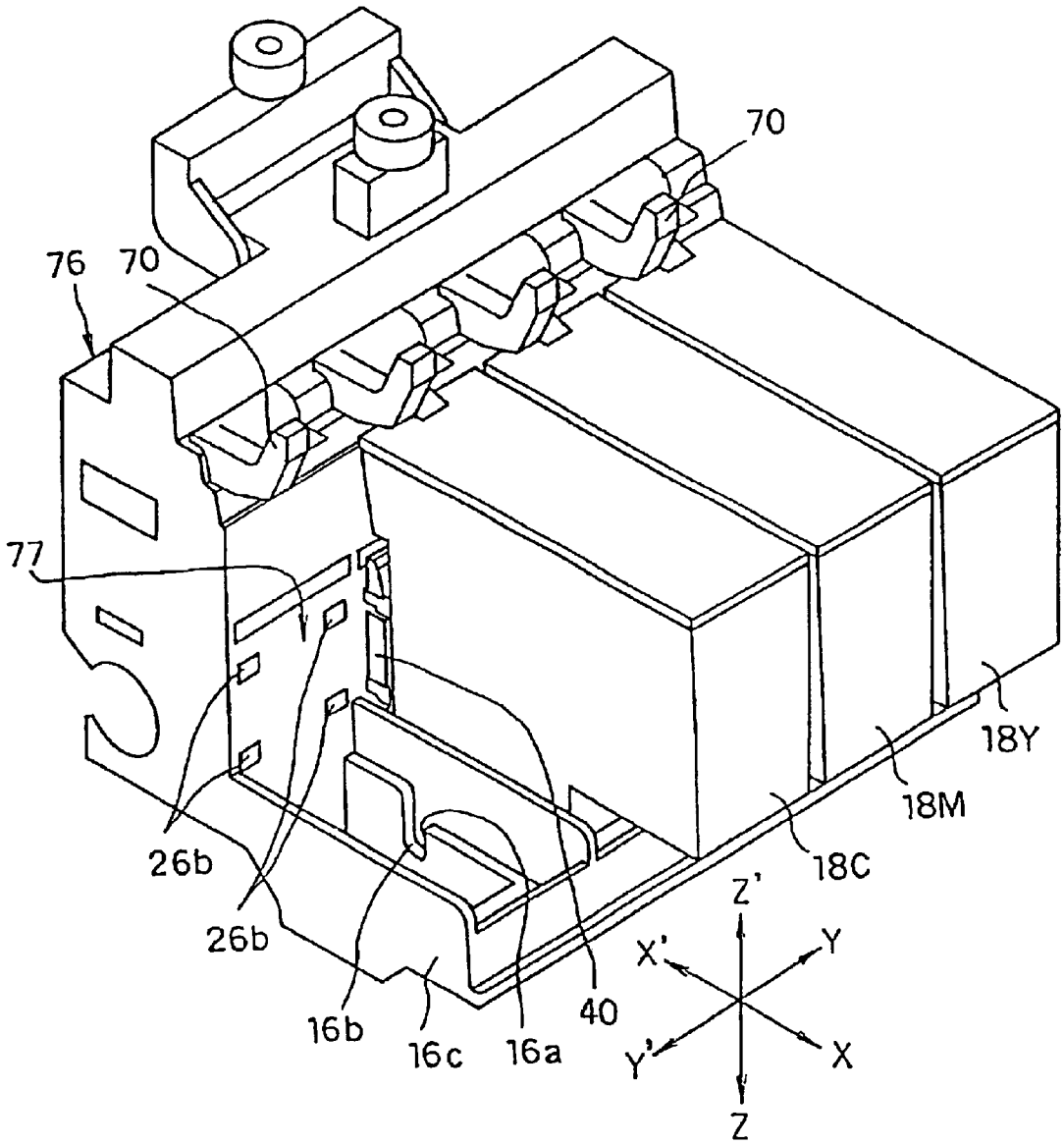
FIG. 9 is a perspective view of a carriage with one printing head and one contact base demounted therefrom.

FIG. 9 is a perspective view of a carriage from which one printing head 18K (black, not shown in the drawing) and one contact base therefor have been demounted. FIG. 10 is a rear view illustrating a back face of a printing head. FIG. 11 is a schematic side view of a carriage carrying printing heads. Here, the printing head 18K is taken as the example. However, the other printing heads 18C, 18M, and 18Y have the same structure. In these drawings, the corresponding constitutional elements are indicated by the same numerals as in FIGS. 1–8.

In comparison with the first embodiment, this second embodiment is characterized by the absence of the hollow 26*a* (see FIG. 2) at the center of the receiving face 77 of the carriage 76, and the presence of a slant face at the fitting holes 60*c* of a flexible head wiring 60 for fitting a protrusion 40*c* of the contact base 40.

As described above, the contact base 40 has a protrusion 40*a* at the gravity center position thereof The protrusion 40*a* has a rounded tip and is in point contact with the receiving face 77. On mounting the printing head 18K onto the carriage 76, the contact base 40 is pushed by the printing head 18K, which allows the contact base 40 to swing in the arrow X, X', Y, Y', Z, Z' directions (in all directions). Thereby, the contact base 40 can become slant or parallel to the receiving face 77.

With such swing of the contact base 40, the connection face 32 of the flexible carriage wiring 30 moves in the arrow X, X', Y, Y', Z, Z' directions to follow the connection face 62 of the flexible head wiring 60. Therefore, even if the connection face 32 is slanted, the connection face 62 comes to be slanted correspondingly. Thereby the two connection faces 32, 62 come close together at a uniform distance over the entire face to ensure the electric connection between the plural electric connection points 30*a*, 60*b*.

On mounting the printing head 18K onto the carriage 76, the protrusion 40*c* on the contact base 40 fits into the fitting hole 60*c* of the flexible head wiring 60. In this fitting, the connection face 62 of the flexible head wiring 60 is moved together with the contact base 40 in the arrow X, X', Y, Y' directions to follow the connection face 62 of the flexible head wiring 60. Consequently, the connection face 62 of the flexible head wiring 60 confronts the connection face 32 of the flexible carriage wiring 30 to ensure further the electric connection between the electric connection points 30*a* of the flexible carriage wiring 30 and the electric connection points 60*b* of the flexible head wiring 60.

Each of the entrance portion of the fitting holes 60*c*, a slant face 60*d* is formed (chamfered). This makes smooth and sure the insertion of the protrusion 40*c* of the contact base. 40 into the fitting hole 60*c* in mounting the printing head 18K onto the carriage 76. Thereby, the connection face 62 of the flexible head wiring 60 and the connection face 32 of the flexible carriage wiring 30 are connected with each other precisely at the predetermined position, and the pressure of the contact between the connection faces 32, 62 is kept uniform stably.

Other embodiments are explained below.

The connection face 32 of the flexible carriage wiring 30 and the pushing member 50 may be fixed, for example, to the printing head 18K, and the connection face 62 of the flexible head wiring 60 may be fixed directly to the contact base 40. Thereby, the same effects can be achieved as in the first and second embodiments.

The protrusion 40*a* of the contact base 40 may be formed on the carriage 16, and the hollow 26*a* of the carriage 16 may be formed on the contact base 40. Thereby, the same effects can be achieved as in the first embodiment.

The protrusion 40*a* of the contact base 40 may be formed on the carriage 76, and the protrusion 40*a* may be removed from the contact base 40. Thereby, the same effects can be achieved as in the second embodiment.

The flexible wiring which does not come into contact with the pushing member 50 (flexible carriage wiring 30 or flexible head wiring 60) need not be flexible.

INDUSTRIAL APPLICABILITY

In the ink-jet imaging apparatus of the present invention, the first circuit face and (or) the second circuit face moves to follow the other circuit face, as described above. Thereby, the first electric connection points and the second electric connection points are mutually connected electrically precisely. Consequently, they are electrically connected precisely, even if the densities of the first electric connection points and the second electric connection points are high.

In the case where the first circuit face moves in a direction crossing the second circuit face to follow the second circuit face, the first circuit face can be moved following the second circuit face in the crossing direction to connect precisely the first electric connection points and the second electric connection points. Consequently, the first and second electric connection points are electrically connected precisely, even if the density thereof is high.

In the case where the second circuit face moves in a direction crossing the first circuit face to follow the first circuit face, the second circuit face can be moved following the first circuit face in the crossing direction to connect precisely the first electric connection points and the second electric connection points. Consequently, the first and second electric connection points are electrically connected precisely, even if the density thereof is high.

In the case where the first circuit face moves in a direction nearly parallel to the second circuit face to follow the second circuit face, the first circuit face can be moved following the second circuit face in the parallel direction to connect precisely the first electric connection points and the second electric connection points. Consequently, the first and second electric connection points are electrically connected precisely, even if the density thereof is high.

In the case where the second circuit face moves in a direction nearly parallel to the first circuit face to follow the first circuit face, the second circuit face can be moved following the first circuit face in the parallel direction to connect precisely the first electric connection points and the second electric connection points. Consequently, the first and second electric connection points are electrically connected precisely, even if the density thereof is high.

In the case where the ink-jet imaging apparatus has the contact base which follows the first circuit face by movement in the aforementioned crossing direction and has the second circuit face fixed thereon, and a pushing member which is held at least between the second circuit face and the contact base, or between the first circuit face and the printing head to press the first circuit face and the second circuit face, the second circuit face fixed to the contact base follows the first circuit face, and the pushing member pushes the first circuit face and the second circuit face, whereby the electric connection points of both of the printing head and the carriage are connected more precisely.

In the case where the contact base moves in the direction nearly parallel to the first circuit face to follow the first circuit face, the parallel movement of the contact base enables precise connection with a higher pressure between the electric connection points of the printing head and the carriage.

Instead of the above contact base, in the case where the contact base fixing the first circuit face moves in the aforementioned crossing direction to follow the second circuit face, the contact base moving also in the crossing direction enables precise connection with a higher pressure between the electric connection points of the printing head and the carriage.

In the case where the contact base moves in the direction nearly parallel to the second circuit face to follow the second circuit face, the movement of the contact base in the parallel direction enables precise connection with a higher pressure between the electric connection points of the printing head and the carriage.

In the case where the contact base has a protrusion near the gravity center of the contact base to contact the carriage, the protrusion placed near the gravity center of the contact base enables smooth movement of the contact base.

In the case where the contact base is capable of moving around the point of touching of the protrusion to the carriage to follow the first circuit face or the second circuit face, the resistance against the movement of the contact base is low, which makes ready and precise the movement to follow the first circuit face or the second circuit face.

In the case where the carriage has a protrusion to be in contact with the contact base near the gravity center of the contact base, the protrusion of the carriage is brought into contact with the gravity center of the contact base, which makes the movement of the contact base smooth.

In the case where the contact base follows the first circuit face or the second circuit face by swinging around the touching point of the protrusion with the contact base as the swing center, the contact base can move with less mechanical resistance and is readily movable, which makes ready the movement of the contact base to follow the first circuit face or the second circuit face.

Further, in the case where either of the first circuit face and the second circuit face confronting the pushing member is flexible, the flexible circuit face can be bent by the pushing action of the pushing member, which makes ready and precise the electrical connection between the printing head and the carriage.

What is claimed is:

1. An ink-jet imaging apparatus which is provided with a printing head having a first circuit face having plural first electric connection points, and a carriage having a second circuit face having plural second electric connection points to be connected respectively to the first electric connection points, and which forms an image by ejecting an ink from the printing head with reciprocating movement of the carriage in a main scanning direction in accordance with image signals transmitted through the first electric connection points and the second electric connection points, wherein one of the first circuit face and the second circuit face moves to follow the other circuit face, each of the first circuit and the second circuit face being pivotable about 2 mutually perpendicular axes.

2. The ink jet imaging apparatus according to claim 1, wherein the first circuit face follows the second circuit face by movement in a direction crossing the second circuit face.

3. The ink jet imaging apparatus according to claim 1, wherein the second circuit face follows the first circuit face by movement in a direction crossing the first circuit face.

4. The ink jet imaging apparatus according to claim 1, wherein the first circuit face follows the second circuit face by movement in a direction nearly parallel to the second circuit face.

5. The ink jet imaging apparatus according to claim 1, wherein the second circuit face follows the first circuit face by movement in a direction nearly parallel to the first circuit face.

6. The ink jet imaging apparatus according to claim 1, wherein the apparatus comprises a contact base which has the second circuit face fixed thereon and follows the first circuit face by movement in the crossing direction, and a pushing member which is held at least between the second circuit face and the contact base and/or between the first circuit face and the printing head.

7. The ink jet imaging apparatus according to claim 6, wherein the contact base follows the first circuit face by movement in a direction nearly parallel to the first circuit face.

8. The ink jet imaging apparatus according to claim 6, wherein the contact base is replaced by another contact base which has the first circuit face fixed thereon and follows the second circuit face by movement in the crossing direction.

9. The ink jet imaging apparatus according to claim 8, wherein the contact base follows the second circuit face by movement in a direction nearly parallel to the second circuit face.

10. The ink jet imaging apparatus according to claim 6, wherein the contact base has a protrusion formed near the gravity center of the contact base and touching the carriage.

11. The ink-jet imaging apparatus according to claim 10, wherein the contact base follows the first circuit face or the second circuit face by swing movement around the touching point of the protrusion touching the carriage at the center.

12. The ink jet imaging apparatus according to claim 6, wherein the carriage has a protrusion to touch the contact base at or near the gravity center of the contact base.

13. The ink jet imaging apparatus according to claim 12, wherein the contact base follows the first circuit face or the second circuit face by swing movement around the touching point of the protrusion touching the contact base as the center.

14. The ink jet imaging apparatus according to claim 6, wherein the first circuit face or the second circuit face confronting the pushing member is flexible.

15. An ink-jet imaging apparatus of the type having a carriage and a printing head attachable to the carriage comprising: a first circuit face having first electric connection points attached to the printing head, and a second circuit face having second electric connection points attached to the carriage, including a contact base having a single protrusion extending from a first surface, said contact base having a second surface on the opposite side of the contact base, the tip of the single protrusion contacting the carriage and defining a touching point with the contact base being pivotable about the touching point on two different axes, said second circuit face positioned on the contact base second surface and being continuously contactable with said first circuit face.

16. An ink jet imaging apparatus according to claim 15 wherein the carriage has a receiving face, said receiving face includes a hollow, said hollow being slightly larger in size than the tip of said contact base protrusion so the tip of said contact base protrusion comes into contact with the bottom face of said hollow.

17. An ink jet imaging apparatus according to claim 15 further comprising at least one protrusion extending from said contact base second surface and extending through said second circuit face, and said first circuit face, and said at least one protrusion being pivotable with the pivotable contact base.

18. An ink jet imaging apparatus according to claim 17 further comprising an elastic pushing member arranged between said contact base second surface and said second circuit face pushing said second circuit face into contact with said first circuit face, and said at least one protrusion extending through said pushing member.

19. An ink jet imaging apparatus according to claim 17 wherein said printing head includes at least one fitting hole for receiving at least one protrusion, said fitting hole having a slant face thereby guiding said at least one protrusion into said fitting hole.

20. An ink jet imaging apparatus according to claim 15 wherein said second circuit face includes plural spherical protrusions at said second electric connection points, said spherical electrical protrusions making electrical contact with said first electric connection points.

* * * * *